US005886723A

United States Patent [19]

Kubelik et al.

[11] Patent Number: 5,886,723

[45] Date of Patent: Mar. 23, 1999

[54] CHARGE DEPOSITION PRINT HEAD AND METHOD OF PRINTING

[75] Inventors: Igor Kubelik, Mississuaga, Canada; Richard A. Fotland, Holliston, Mass.

[73] Assignee: Delphax Systems, Canton, Mass.

[21] Appl. No.: 639,851

[22] Filed: Apr. 19, 1996

Related U.S. Application Data

[63] Continuation-in-part of Ser. No. 435,096, May 4, 1995, abandoned.

[51] Int. Cl.[6] ..... B41J 2/41

[52] U.S. Cl. ..... 347/120

[58] Field of Search ..... 347/55, 112, 120, 347/127, 141, 142, 143, 144, 145

[56] References Cited

U.S. PATENT DOCUMENTS 4,999,653 3/1991 McCallum ..... 347/127
5,006,869 4/1991 Buchan et al. ..... 347/127

*Primary Examiner*—David F. Yockey
*Attorney, Agent, or Firm*—Lahive & Cockfield, LLP

[57] ABSTRACT

A print head has a matrix array of charge generating loci defined by crossings of a first set of electrodes which are parallel to each other and extend across the region to be printed and a second set of electrodes that extend obliquely across the first electrodes so that the crossings are closely spaced lattice points. The charge deposited by a lattice point varies with the position of the first electrode defining the point, but the electrodes are arranged so charge carriers are generated or gated for projection onto a latent imaging member with local charge dot uniformity. In one embodiment of the invention, there are an odd number of first electrodes, and the second electrodes are arranged such that when electrodes are actuated, pairs of adjacent dots are deposited by pairs of lattice points having complementary variations in charge. As viewed or measured along the print line, each pair of deposited dots has a substantially uniform level of charge, and doubling and extreme discontinuities do not occur. The second electrodes may overlap in a cross scan direction to interleave their deposited charge dots. Alternatively, using zig-zag but non-overlapping electrodes, each electrode may deposit a continuous uninterrupted sequence of dots while still achieving a uniform regional charge distribution. In another aspect, the second electrodes include first and second subsets of electrodes having a different pitch defining two sets of charge loci at lattice points slightly shifted in the cross-scan direction to interleave strong dots with weak dots without doubling. This embodiment includes print heads with an even number of first electrodes without introducing aliasing patterns of charge density.

11 Claims, 12 Drawing Sheets

CHARGE DEPOSITION PRINT HEAD AND METHOD OF PRINTING

RELATED APPLICATIONS

This is a continuation-in-part of U.S. Ser. No. 08/435,096 filed May 4, 1995, now abandoned.

BACKGROUND

The present invention relates to charge disposition print heads of the type wherein selectively controlled electrodes, generally arranged at two or more levels in a laminated construction, are disposed to define a matrix array of charge-generating or gating points from which charge carriers are directed at an imaging or latent imaging member moving along a scan direction past the head. Such print heads allow a thin rectangular strip of charge generators to deposit an image of arbitrary length, with high resolution, on an imaging member as it moves past the head, and they are readily adapted to print computerized graphic image and text data.

Print heads of this type are described in U.S. Pat. Nos. 4,160,257; 4,992,807; 5,278,588; 5,159,358; and many others. In the print heads described more particularly in the aforesaid patents, long driver electrodes spanning a page format on an insulting sheet are activated with an RF signal of up to several thousand volts amplitude while lesser bias or control voltages are applied to other electrodes on the other side of the sheet to create localized charge source regions located at or near crossing points with the driver electrodes and allow charge carriers to escape from the glow or discharge regions and be accelerated to an imaging member. These print heads may be configured to deposit either positive or negative charge, and the negative charge may consist partly or entirely of either ions or electrons. These heads are configured so that the charge deposited by each discharge locus forms a small dot-like latent charge image on the imaging member as it moves past. Each raster scan of the head electrodes thus fills a narrow image strip, with the totality of image strips forming an image page.

In printing devices using this type of head, the RF-driven discharge generation line may extend generally along the length of the print head, spanning many of the control electrodes which cross them at an angle. In one commercial embodiment, by way of example, 20 parallel RF lines extend the width of a print page, and these are crossed by 128 oblique control electrodes, known as finger electrodes. During the time when one RF line is activated by a burst of approximately 5 to 25 cycles of a one-half to ten MHz drive signal with a peak-to-peak amplitude of several thousand volts, those finger electrodes which cross the RF line at the desired locations are selectively biased to project charge dots from the head at the pixels where a print image is to be formed. Each finger is effective to project up to twenty charge dots, arranged along its length, corresponding to the twenty adjacent RF drive lines crossing the finger. The last projected dot (e.g., from drive line 20) of one finger may be adjacent to the first dot (the crossing point with drive line 1) of the neighboring drive. The drive electrodes generally extend at a pitch which allows the electrode-crossing points to be relatively widely spaced along the length of the finger, yet have a much smaller spacing in the cross-scan direction of imaging. Thus, by actuating different drive lines having electrode crossing sites on the same finger but at slightly different times as the imaging member is moved in a scan direction past the print head, a finger may deposit dots closely adjacent to each other on a single print line, or to dots of successive lines.

Other forms of charge deposition print head are also known. These may include structures wherein electrodes spaced on opposite sides of an insulating plate or sheet surround apertures through the sheet which define the sites at which charge carriers are gated through to land on an imaging member. Such constructions may be used to define image points and to control the flow of ions from a plasma chamber, or may even be used to directly gate charged toner particles onto an imaging member in a direct printing process. In addition various charge dot generating structures have been proposed utilizing semiconductor solid state electron emitter arrays, as well as electron field emitter arrays which rely primarily on microdimensioning to achieve effective field strengths for emitting electrons.

Returning to the first type of print head discussed above, these are generally operated at a relatively small gap of about one-quarter millimeter from the image receiving sheet, belt or drum, and they are biased with respect to the imaging member to maintain a relatively high electrostatic acceleration field which transports the charged particles across this gap. The amount of charge or charged particles which must be deposited to form an effective imaging dot is generally so great as to result in a considerable build-up of charge at the dot locus on the charge-receiving surface of the imaging member, relative to the magnitude of the acceleration potential. Thus, as a latent dot charge is formed, a local electric field develops which tends to deflect later arriving charge carriers directed at or near that dot. This effect results in "blooming" or enlargement of individual dots, such as described in the aforesaid U.S. Pat. No. 5,278,588, and various approaches are taught therein for addressing the precision of dot placement and image control to overcome deleterious the effect of dot blooming on image resolution. This surface charging effect also slightly deflects dots which are aimed nearby. This related effect, known as "Venetian blinding". occurs when electrodes are actuated to lay down a latent charge dot on the imaging member at a position closely adjacent to one or more charge dots which have already been laid down along a line or region. In this case, the already deposited charge deflects the incoming charge carriers so that the subsequent dot is shifted laterally and positioned wrong. Since the RF lines are few in number and are actuated in a generally fixed sequence, an effect similar to aliasing also occurs, wherein the print head generates a ripple or line of misplaced dots that appear as a streak or an anomalously light or dark band periodically crossing the face of the print. One approach to correcting Venetian blinding is taught in commonly owned U.S. Pat. No. 5,450,103. That approach involves providing a second array of electrodes which can be actuated to correct the small deflection fields existing at the surface of the imaging member, so that charge trajectories remain on target and deposit dots of uniform size.

Finally, a third effect arises due to variations in spacing of the print head from the image-receiving member. If the image receiving member is a curved drum, or a belt which passes over a drum opposite to the print head, then the RF line or lines closest to "top dead center" of the drum will be closest to the imaging member, while RF lines adjacent thereto and outward from the center will be further away from the imaging surface due to curving-away of the drum surface. The increased gap results in lower extraction or acceleration field strengths, with the result that less charge is emitted by and deposited opposite to these outer electrodes. The periodic actuation of RF drive lines and scanning of the drum past the head therefore results in a pattern of weak and strong charge dots which can also give macroscopically-visible banding or texture to the developed charge image.

Thus, despite the apparently high degree of symmetry of existing charge deposition print heads, a number of macroscopically visible irregularities are produced in the images which they deposit.

These problems were partially solved by introducing an interleaved finger electrode configuration as described in U.S. Pat. Nos. 4,999,653 and No. 5,006,869; however using this arrangement some anomalously lighter or darker streaks persisted.

It would be desirable to achieve uniform dot deposition without requiring coordination of additional electrodes and without losing the basic simplicity of the raster electrode actuation employed to drive charge deposition heads of the prior art.

SUMMARY OF THE INVENTION

This is achieved in a print head in accordance with the present invention wherein a matrix array of charge generating loci is defined by the crossing points of a first set of electrodes and a second set of electrodes. Electrodes of the first set are parallel to each other and extend across the region to be printed, while electrodes of the second set are also parallel to each other, but extend obliquely across the first electrodes in a plane parallel thereto to define the crossing points. The crossing points of the first and second electrodes are closely spaced lattice points at which charge carriers are generated or gated for projection onto a latent imaging member such that charge dots are uniformly deposited. In one embodiment of the invention, there are an odd number of first electrodes. This permits the electrodes to be actuated such that pairs of adjacent dots are deposited by pairs of charge generating loci having complementary variations in charge output. As viewed or measured along the print line, each pair of deposited dots then has a substantially uniform level of charge and extreme discontinuities do not occur. In another embodiment, the second electrodes include a first subset of electrodes having a first characteristic spacing and a second subset of electrodes having a second characteristic spacing. Both the first and second subsets of electrodes are parallel and all have the same pitch, but the crossing points of the first and second subsets of second electrodes define corresponding charge-generation loci which are lattice points with shifted lattices in the cross-scan direction. In this embodiment, the second electrodes may overlap in the cross-scan direction to intersperse strong dots and weak dots when the first electrodes are actuated. In this embodiment, an even number of first electrodes may be provided, and these may be actuated in normal sequence, without introducing aliasing patterns of print density.

BRIEF DESCRIPTION OF DRAWINGS

These and other features of the invention will be understood from the description herein and the claims appended hereto, read in light of the art and with the benefit of illustrative drawings, wherein

DETAILED DESCRIPTION

Figure 1:
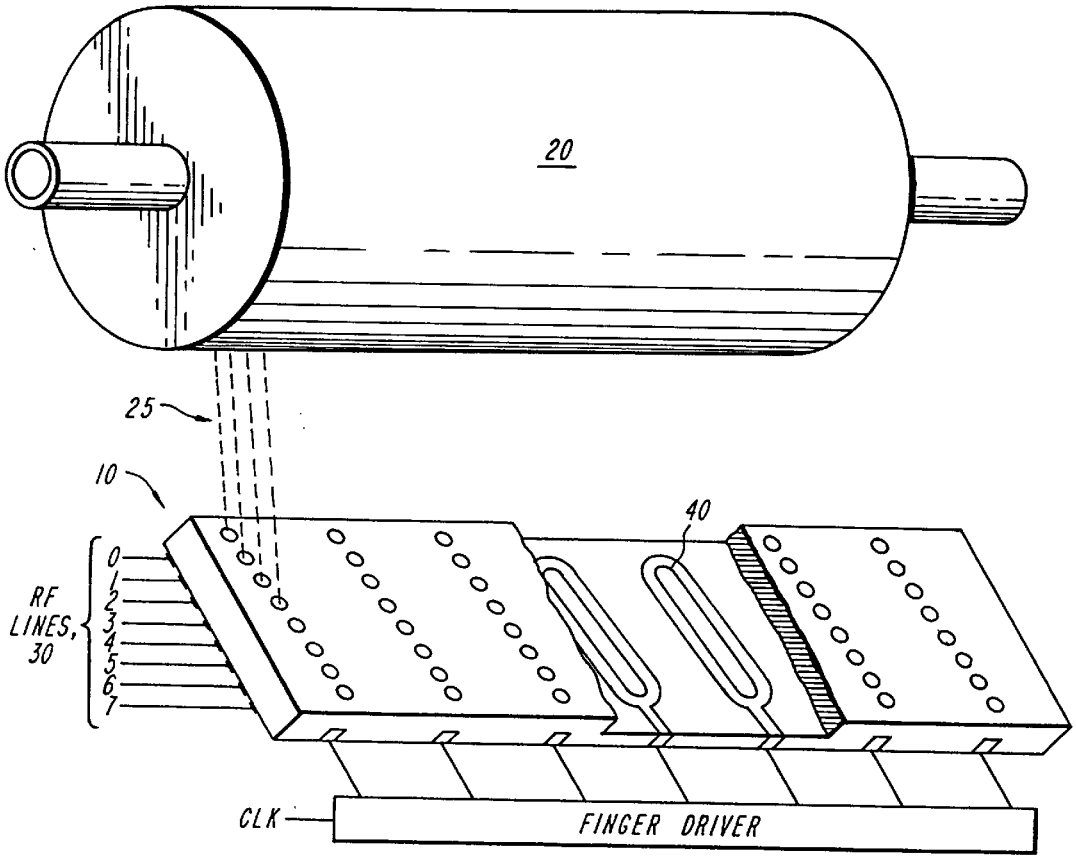
FIG. 1 (PRIOR ART)
FIG. 1 and 1A illustrate a conventional charge deposition print head.
Figure 1A:
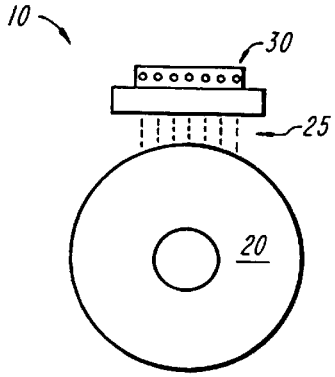
FIG. 1A (PRIOR ART)

FIG. 1 illustrates a conventional charge deposition print head 10 which, as shown, is spaced opposite to an imaging drum 20 and projects charged particles 25 onto the drum surface. As illustrated, the head 10 has a plurality of RF drive lines 30 and these are crossed by finger electrodes 40. Charged particles are generated by and emitted from the head at each point where a drive line 30 and a finger electrode cross. For clarity of presentation, the gap between the head 10 and the imaging drum is greatly exaggerated. Also, the RF or drive electrodes are numbered in order from 0 to 7. As shown in FIG. 1A viewed along the axis of the print drum 20, the drum curves away from the print head. The head is mounted parallel to the axis of drum 20 and tangent to its surface at a spacing of about 0.25 mm, so that the central electrodes—the third and fourth—will in practice be closest to the drum, while the edge electrodes have a larger electrode-to-drum gap and will deposit progressively less charge. The curvature of the drum is exaggerated for illustration, but in practical embodiments the drop-off is sufficiently large, although only 0.05 to 0.5 mm, to affect the charge transport mechanisms involved. For example, taking the excess charge deposited by the central electrodes over that delivered by the outermost electrodes, in arbitrary units, to be three, the second and fifth electrode deposit two excess charge units, while the first and sixth electrodes deposit one excess charge unit. The outermost of the eight electrodes (numbered 0 and 7) deposit the least charge.

It should be borne in mind that the RF drive lines are swept in a regular order, e.g., the high voltage RF signal is applied to them in the order 0. 1. 2. 3. 4. 5. 6. and 7. Thus pairs of the "weak" outer electrodes (numbers 7,0) are actuated to deposit adjacent dots, as are pairs of "strong" electrodes (the central ones, 3,4). This causes the variation of local charge among double dot regions to become even more extreme than the variation in single dot charge distribution.

Figure 2:
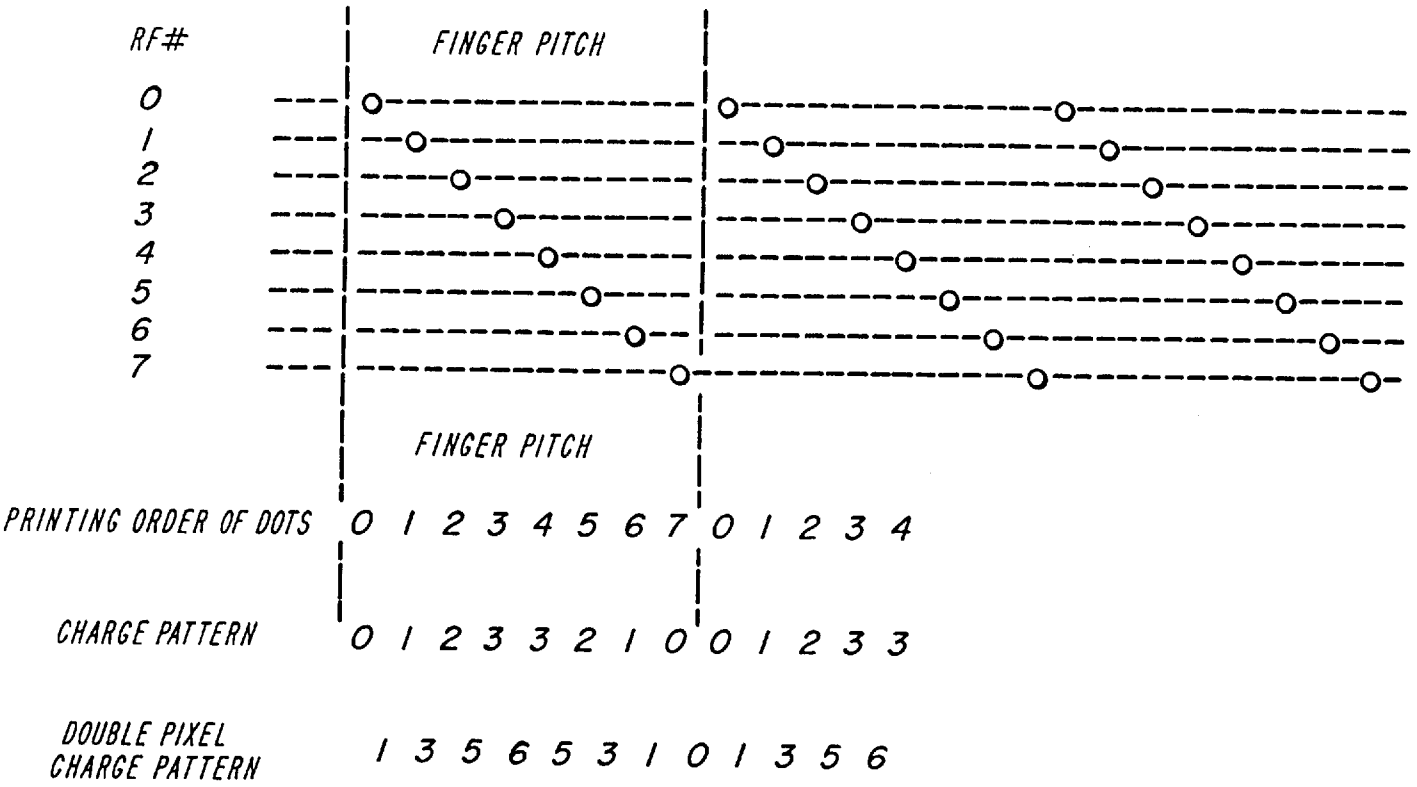
FIG. 2 (PRIOR ART)
FIG. 2 illustrates the operation and charge pattern of the head of FIG. 1.
Figure 3:
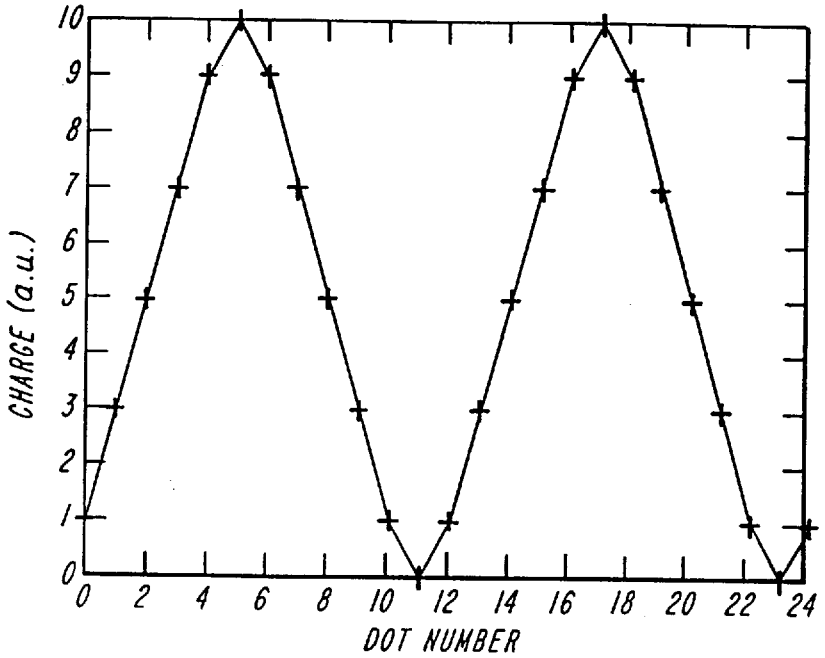
FIG. 3 (PRIOR ART)
FIG. 3 is a graph representative of deposited charge for the operation illustrated in FIG. 2.

FIG. 2 illustrates this phenomenon. The top portion of the FIGURE shows the layout of drive lines 0–7 and the finger electrodes, with the finger "pitch" P equal to the short cross-scan distance (horizontal, as shown) spanned by the eight crossing points of the finger electrode. The first line of legend below the drawing illustrates the sequential actuation order of the drive lines 0–7, which corresponds to the order of printing the successive dots along the line. The second line of the legend indicates the relative excess charge delivered at each point when the dots are actuated as in the first line. Finally, the third line shows the total excess charge delivered to the two-dot region at each point. As shown, the excess charge delivered near the finger electrode end crossing points, in arbitrary units, is zero (low), while the delivered excess charge below the central crossing points is six. FIG. 3 graphs this charge distribution for a twelve-drive-line head of this type actuated in sequential electrode order, showing the characteristic peak at central finger dots and the excess charge drop-off at each end. The variation is so extreme as to affect print quality.

Figure 5:
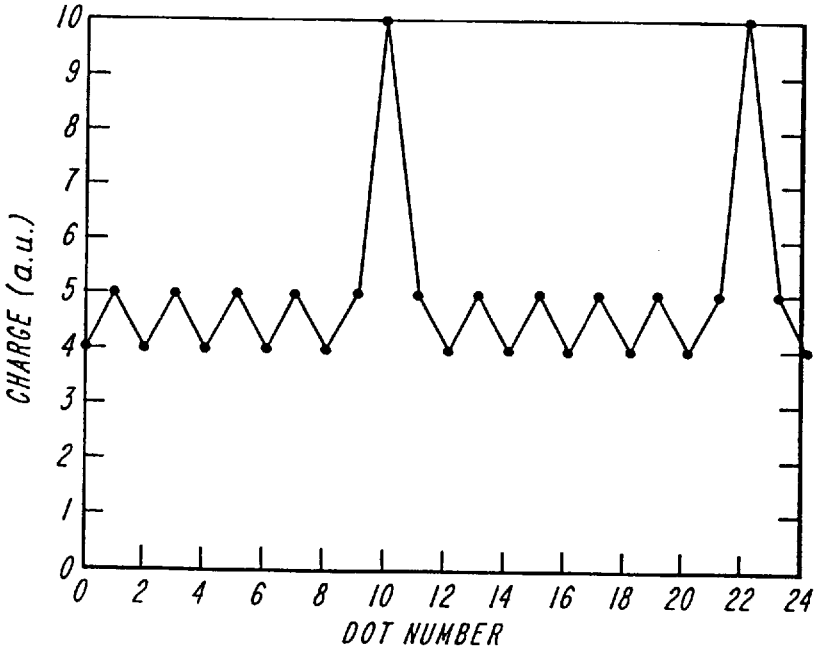
FIG. 5 (PRIOR ART)
FIG. 5 indicates the distribution of deposited charge obtained with the method of FIG. 4.
Figure 4:
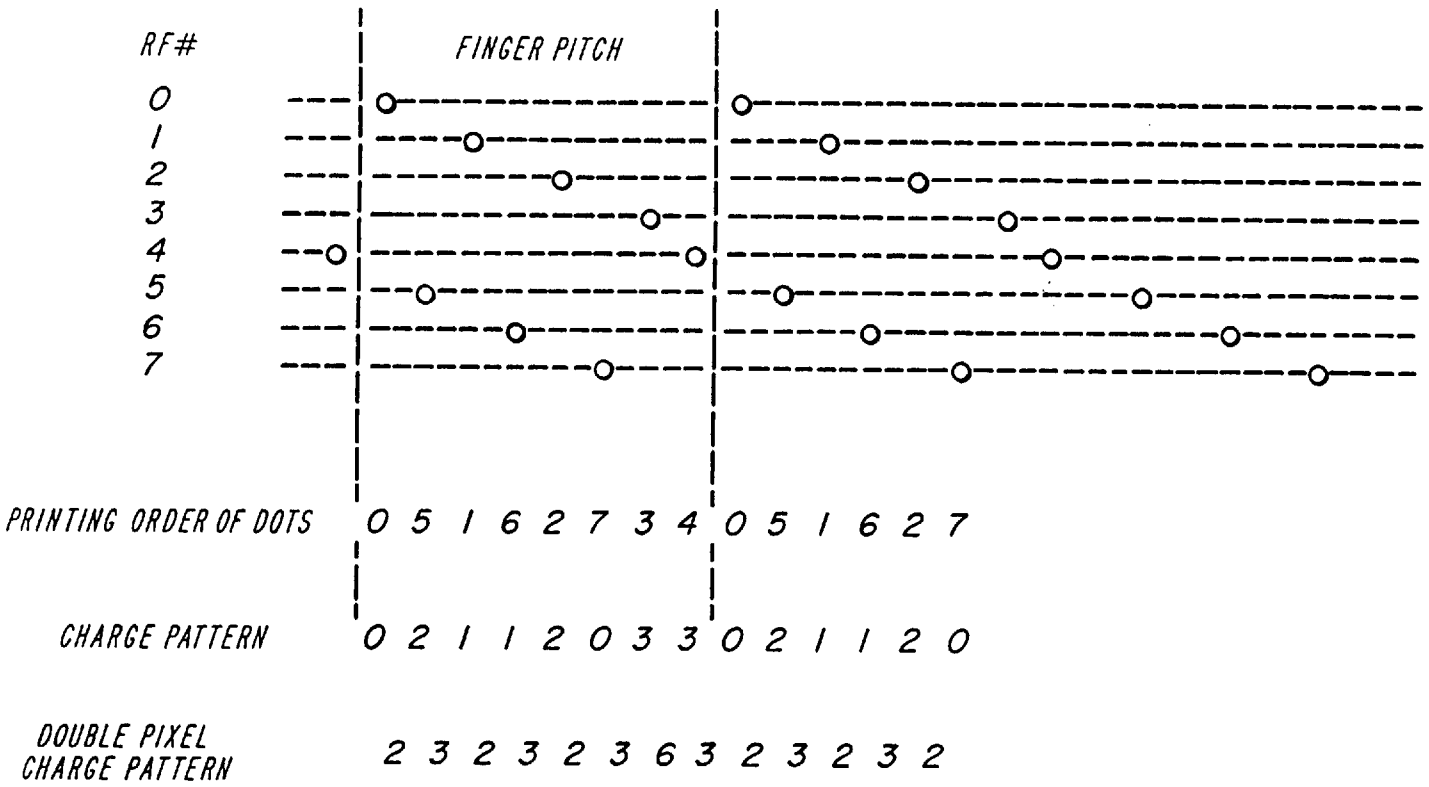
FIG. 4 (PRIOR ART)
FIG. 4 illustrates another prior art head and method of operating for improved uniformity.

FIG. 4 shows one prior art finger/driver electrode configuration in a print head for smoothing the distribution of delivered charge. As shown in FIG. 4, this extreme periodic variation in delivered charge is partially corrected by using a head structure wherein finger electrodes are arranged at a much lower pitch with charge generating loci of a single finger electrode at twice the spacing. The adjacent fingers overlap in the cross-scan direction with each other along one-half their length. With this arrangement, when the drive lines are actuated in sequential order (0–7), the dots deposited by the drive lines are laid down in a time and space sequence such that the problem of earlier deposited strong dots deflecting later actuated weak charges generally does not arise, and adjacency of same-valued charge extremes is reduced. As shown in the first data line at the bottom of FIG. 4, weak dots printed from the outer most drive line are placed next to strong dots generated by the central drive line. The excess deposited charge pattern indicated in the second line of the FIGURE still has two strong dots printed together with each full actuation sequence of the drive lines. Correspondingly, the double pixel charge pattern, shown in the third line of the FIGURE, is substantially more uniform than that of FIG. 2, but still has a single extreme value occurring for the three/four drive line dot pair. FIG. 5 shows a graph of this charge distribution.

Figure 6:
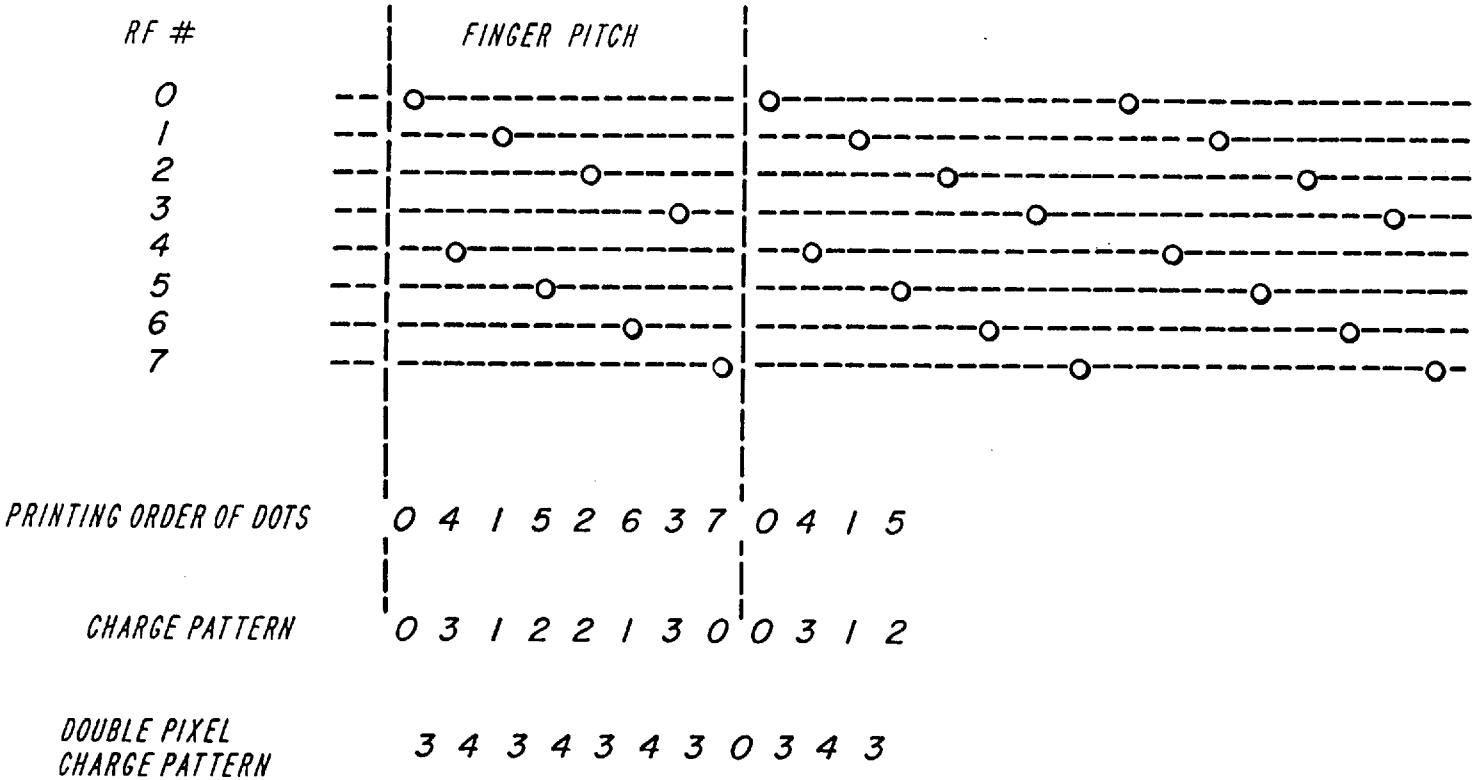
FIG. 6 (PRIOR ART)
FIG. 6 illustrates another prior art method for operating the head of FIGS. 1 and 2.

Another prior art finger arrangement for interleaved dots is shown in FIG. 6. In this configuration, the strongest dots are separated, but now the two weakest (outermost) dots are printed adjacent to each other. As with FIG. 4, three lines of data below the FIGURE show the printing order of dots, the charge dot magnitude pattern produced thereby, and the double pixel charge levels. Here there is again a substantial uniformity of the double pixel charge values, with the exception that one extremely low value occurs with each full cycle of driver electrode actuation.

Applicant has found in general that if a print head has an even number of drive lines, one cannot achieve a completely uniform charge distribution. If one attempts to alternate "weak" and "strong" holes of the print head, this imposes a requirement that between any two dots $D_n$ and $D_{n+1}$ printed by two consecutive drive lines n and n+1 during the first half of the print cycle there should be placed the dot $D_m$ printed during the second half of the print cycle, corresponding to the drive line m given by $$m = \frac{n + (n+1)}{2} + \frac{N}{2} \tag{1}$$

where N is the total number of drive lines, and m, n and N are all natural numbers.

Intuitively, this corresponds to a drive line m which is as close to the center as the lines n, n+1 are to the outside edge, and thus has a complementary charge variation. More generally the formula could be written:

$$m = \tfrac{1}{2}(N+2n+1) - N*INT(\tfrac{1}{2}N(N+2n+1)) \tag{2}$$

These two requirements cannot be satisfied if the number N of drive lines is even.

Applicant has found, however, that by using a print head with an odd number of drive lines, the conditions described by equation (1) and (2) can be fulfilled and a much higher degree of dot uniformity may be dependably achieved using a variety of finger electrode layouts.

Figure 9:
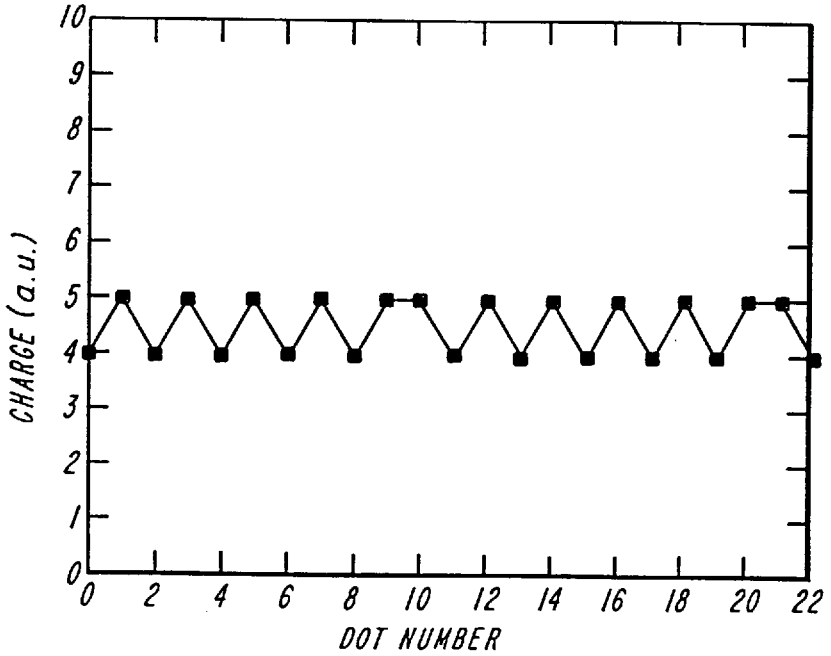
FIG. 9 shows charge distribution obtained with the print head of FIG. 8.
Figure 8:
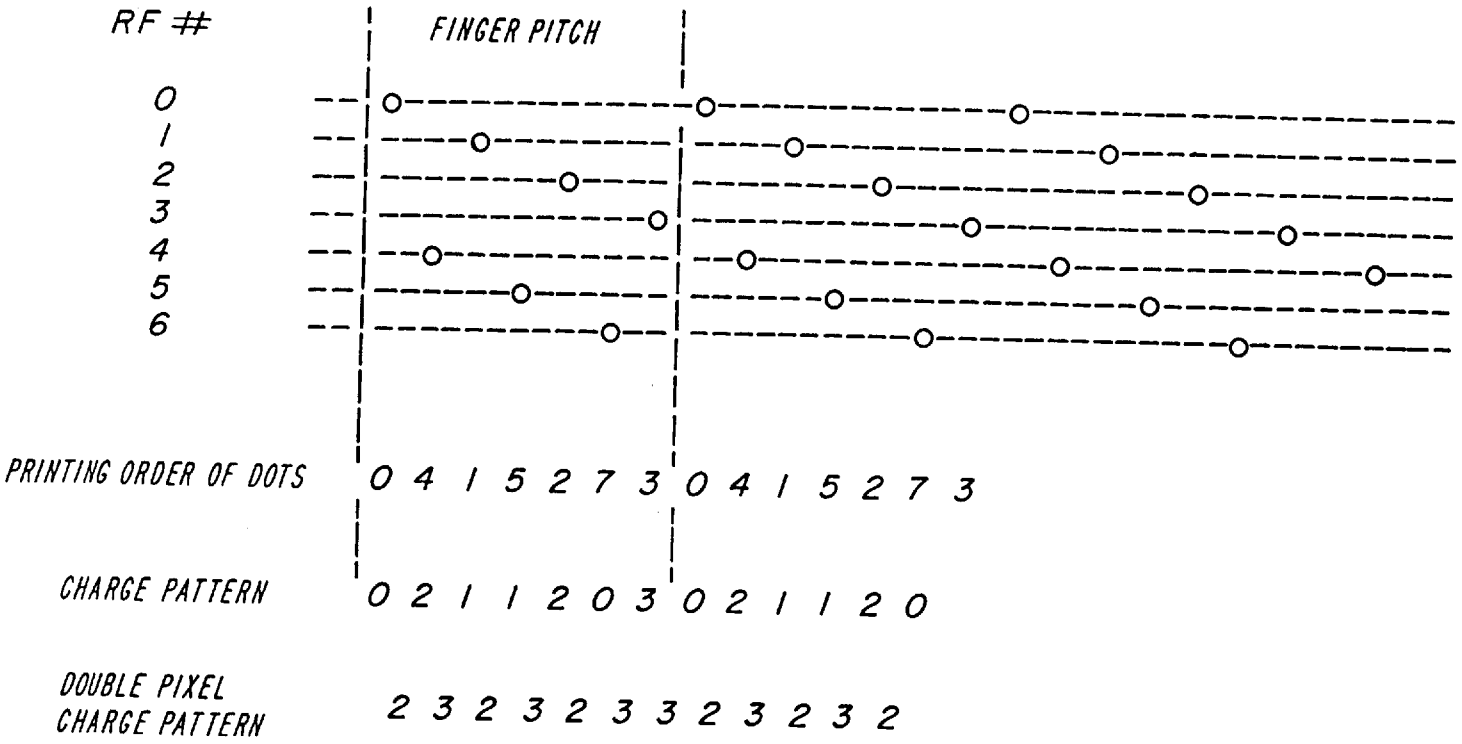
FIG. 8 shows a print head in accordance with the present invention.

FIG. 8 is a drawing corresponding to the schematic representations of FIGS. 2, 4, and 6, showing a seven drive line print head in accordance with the present invention, and its operation. Using an odd number of drive lines, there is a single central electrode, and charge drop off is symmetrical around it. Furthermore, with this electrode configuration, by applying the standard sequential actuation of drive electrodes, the strong central dot is bracketed by weak dots and the double pixel charge pattern has no extreme peak or dips, as illustrated in the third data line of the FIGURE. FIG. 9 is graph of deposited charge illustrating this uniformity and the absence of extreme variation. Note that in this embodiment, the fingers again run at a low pitch and are interleaved such that one half of each finger overlaps in the cross-scan with each of the fingers adjacent to it. Thus, the cross-scan or dot position coordinates of three electrode crossings of one finger fall between the dot position coordinates of four electrode crossings of the adjacent finger.

Figure 10:
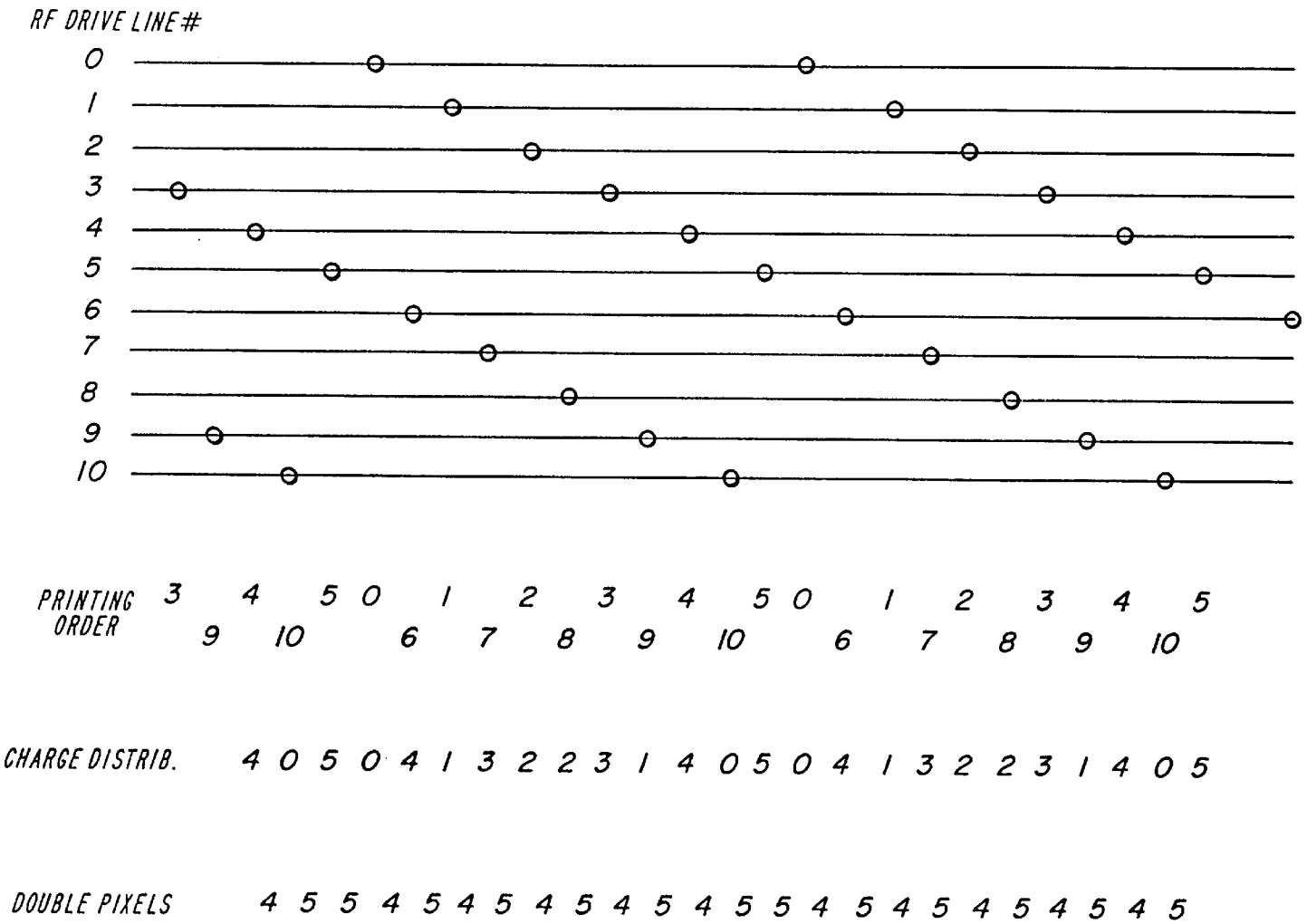
FIG. 10 illustrates another print head in accordance with the present invention.

FIG. 10 illustrates another embodiment of a head configured in accordance with the present invention, having an odd number, eleven, of drive electrodes. The dot printing order and the single and double dot charge variations are illustrated in the bottom data lines of the FIGURE. Again, a substantially uniform level of delivered charge is achieved.

Thus, by providing an odd number of drive electrodes, the finger and drive electrodes may be actuated to interleave strong and weak dots and avoid doubling and extreme values. The foregoing examples illustrate the manner in which localized charge irregularities are avoided in a print head having an odd number of drive lines. Essentially, this construction provides a solution to equations (1) and (2) above, allowing complementary charge dots to be interspersed for all drive line positions, thus avoiding the aliasing or beat-like occurrence of light or dark latent image streaks.

In another aspect of the invention, charge variations are reduced by a print head electrode configuration wherein changes in finger electrode array spacing result in a charge-uniform interleaving of the delivered charge.

Figure 11:
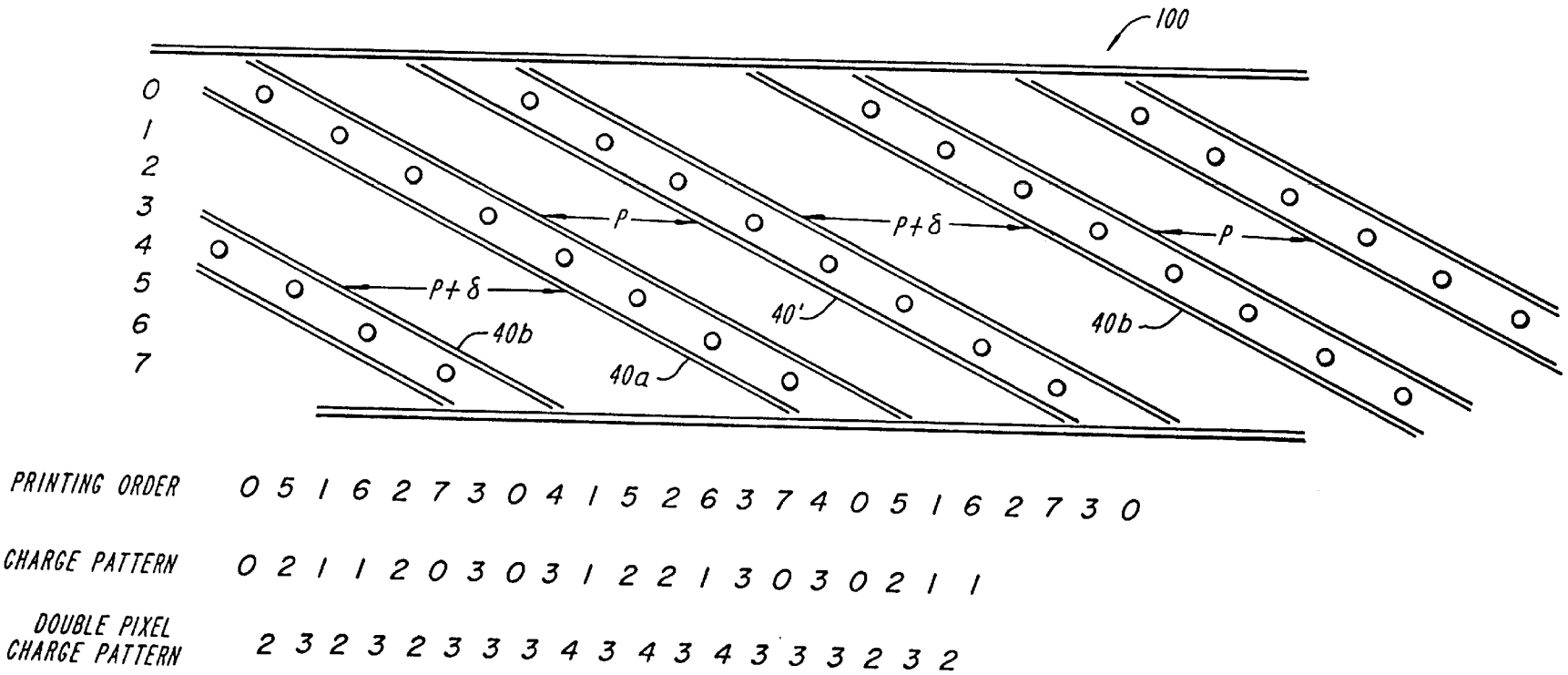
FIG. 11 illustrates a third construction of a print head in accordance with the present invention.

FIG. 11 shows such a print head embodiment 100 for achieving uniformity of delivered charge dots. In this embodiment, a set of eight parallel drive electrodes cross a plurality of finger electrodes to define charge generation loci. The finger electrodes differ from a conventional print head in having two distinct subsets. A first set of fingers have a uniform spacing or pitch indicated by the interfinger distance "p". A second plurality of fingers are located at a different spacing, p+δ, which is shifted slightly from the uniform pitch as shown in the FIGURE. With this arrangement, the outer or weak holes of the fingers 40*a*, 40*b*, on each side of a given central finger 40' are positioned between the strong central holes of the finger 40'. The result is that with the normal printing order of drive electrodes 0 to 7 swept out in sequence, there is no position at which two dots are deposited adjacent to each other by the outermost electrodes, nor at which two dots are deposited adjacent to each other by the central innermost electrodes. The resulting double pixel charge pattern is shown in the third line of the data legend in FIG. 11. Total charge variation is equivalent to the usual variation over a two drive line spacing, but there are no extreme values in the charge distribution. Thus, substantial charge dot uniformity is achieved with conventional sequential drive line actuation in a head with any number of drive lines, by interleaving dots from fingers of two different pitches or lattice spacings.

It should be noted that the FIGURES discussed above show the single dot charge values, and the two-dot charge values, but do not address larger patterns of streaking which might result. In fact, with an even number of drive electrodes or the smoothing approach taken in FIG. 11, somewhat greater "banding" effects or fluctuation of higher width units, such as four-dot units may occur. The first aspect of the invention, utilizing an odd number of drive lines, is therefore preferred over simply shifting the pitch of finger electrodes.

On the other hand, it should also be observed that in order to obtain interspersed dots of complementary charge variation, it is not necessary that the finger electrodes each overlap the range of an adjacent electrode, as occurs in the embodiments shown in FIGS. 8 and 10, although such an arrangement is useful for increasing the electrode spacing, and thereby easing dimensional constraints on manufacturing or connecting the print heads. Rather than such interleaved fingers, in other embodiments of the invention charge dots are deposited in an interspersed fashion by single finger electrodes. Several examples of such embodiments are shown in FIGS. 14–17 discussed below.

FIGS. 12–17 illustrate a range of electrode configurations, illustratively in a print head having five drive lines denoted, RF0, . . . RF4.

Figure 7:
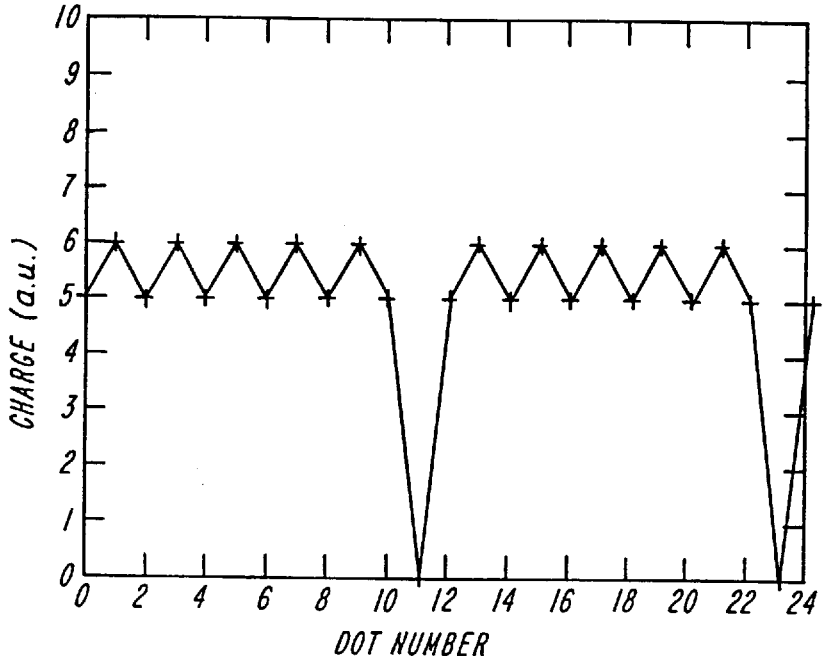
FIG. 7 (PRIOR ART)
FIG. 7 indicates the charge distribution obtained with operation of FIG. 6.
Figure 12:
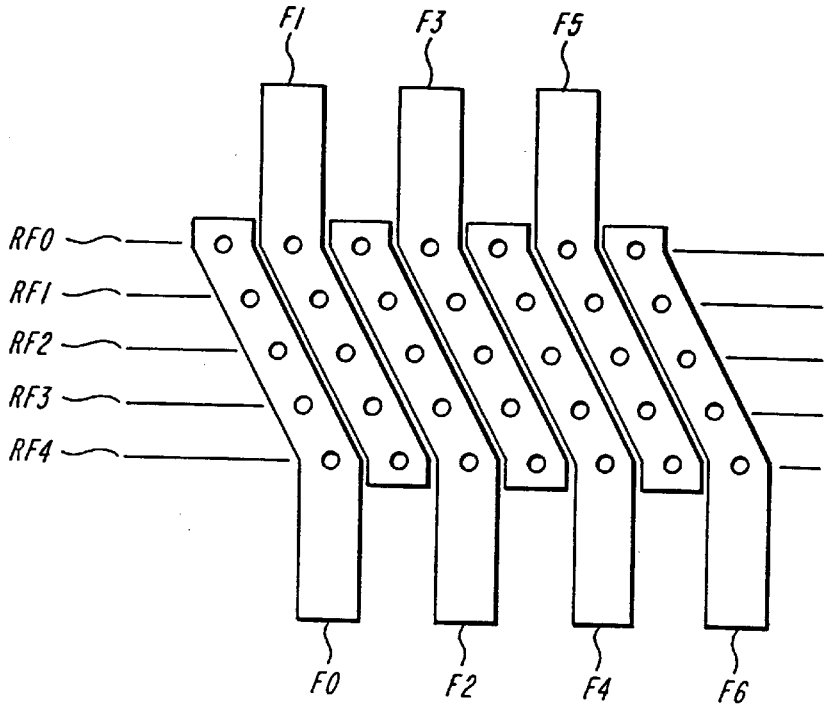
FIGS. 12–17 illustrate other configurations of finger electrodes in print heads of the present invention.
Figure 13:
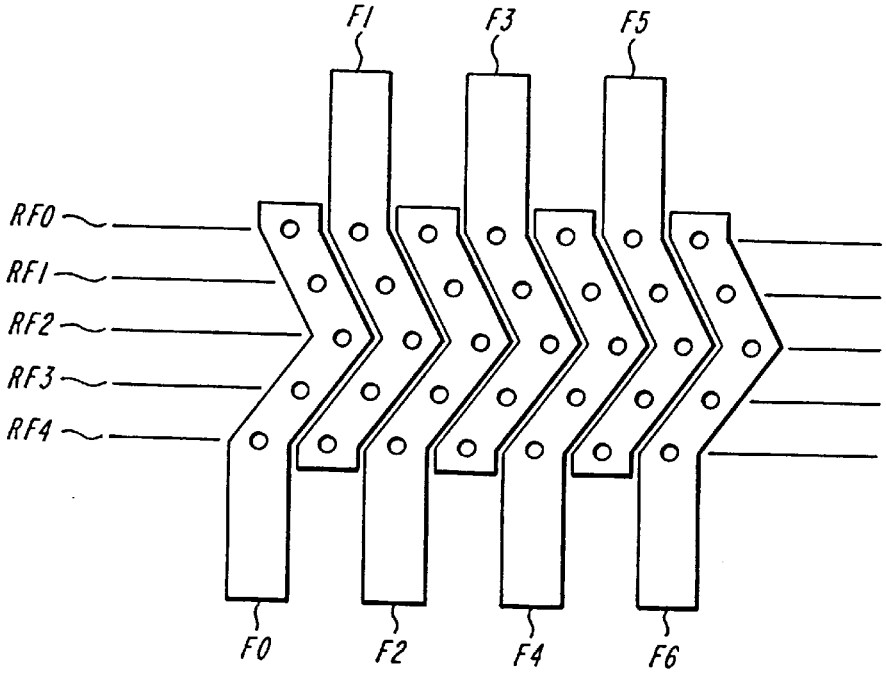

In the embodiment of FIGS. 12 and 13, charge dots projected from a single finger electrode Fi (i=1, . . . n) are interspersed with dots projected each adjacent finger electrode. The fingers also extend out to connection points at opposite edges of the print head, so that all the odd numbered fingers F1, F3 . . . contact leads or are energized at the top edge, while the even numbered fingers F0, F2 . . . are energized from the opposite (bottom) edge. This latter feature is a known matter of electrode layout to allow better accessibility and electronic isolation of the finger electrode connections, but has no bearing on the invention discussed herein. In all critical respects the five driver electrode print heads of FIGS. 12 and 13 are similar to the seven and eleven line heads of FIGS. 7 and 10, respectively.

Figure 14:
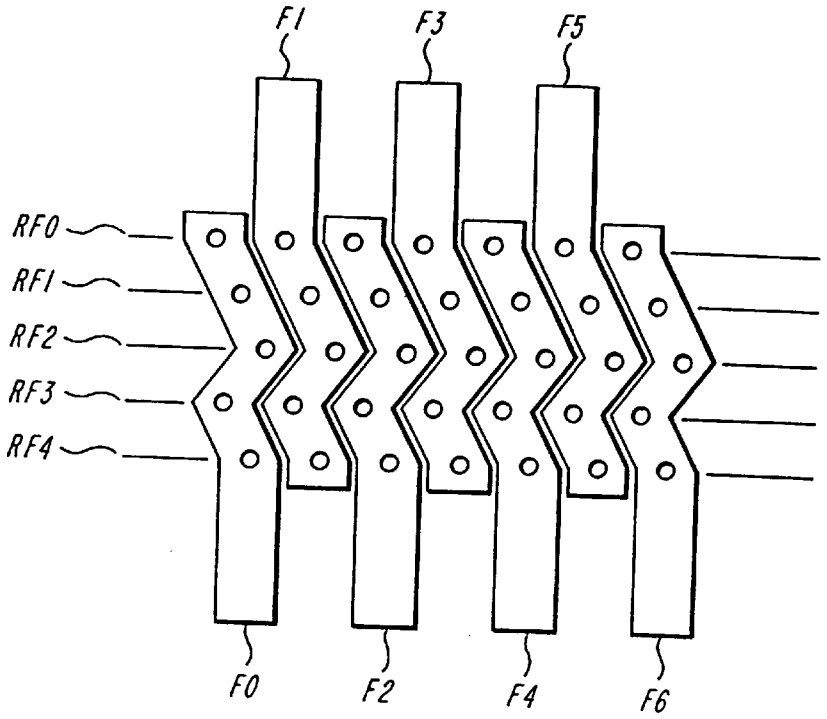
Figure 15:
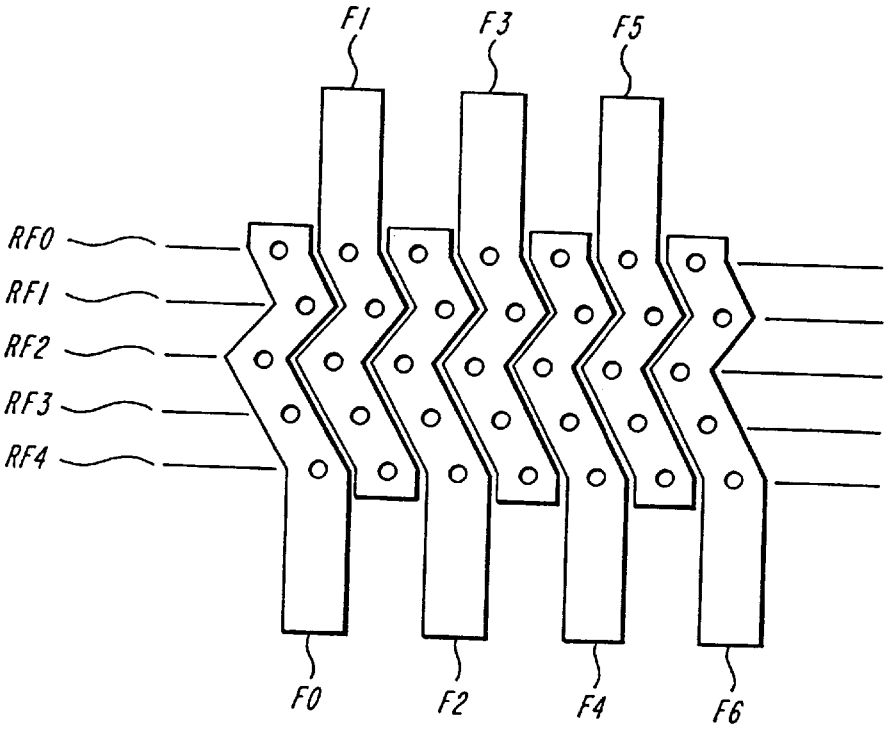

Continuing with description of the Figures, FIGS. 14 and 15 show configurations wherein complementary charge dots are alternated with each other but deposited by a single finger, rather than an interleaved set of fingers. These two configurations will be seen to be identical, except for a left-right and top-bottom reflection, i.e., a half-revolution in the plane of the drawing, and they provide dot alternation by extending in a zig-zag pattern with a long and at least one shorter segment, arranged so that charge loci on one segment of the zig-zag fall between those of another having an appropriately different, e.g., complementary, charge output.

Figure 16:
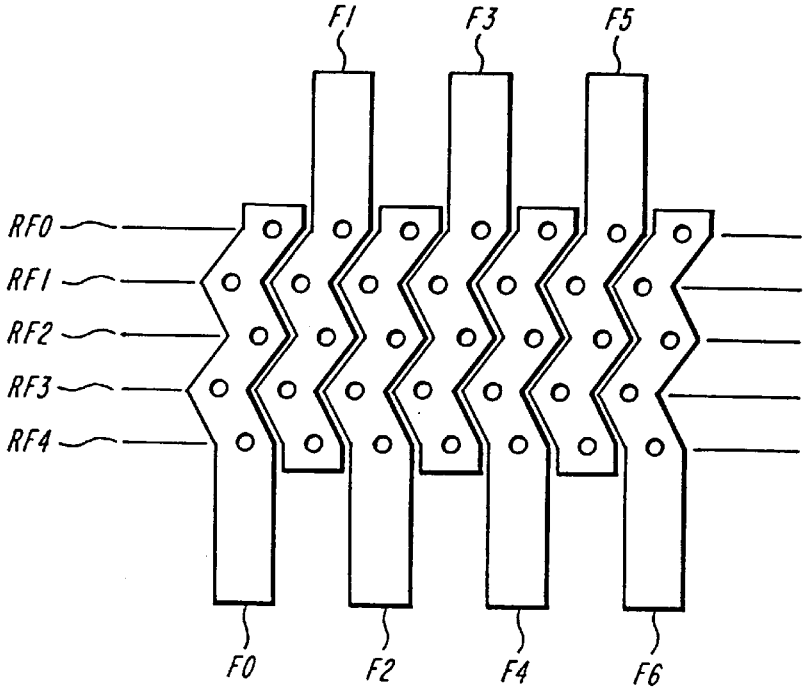
Figure 17:
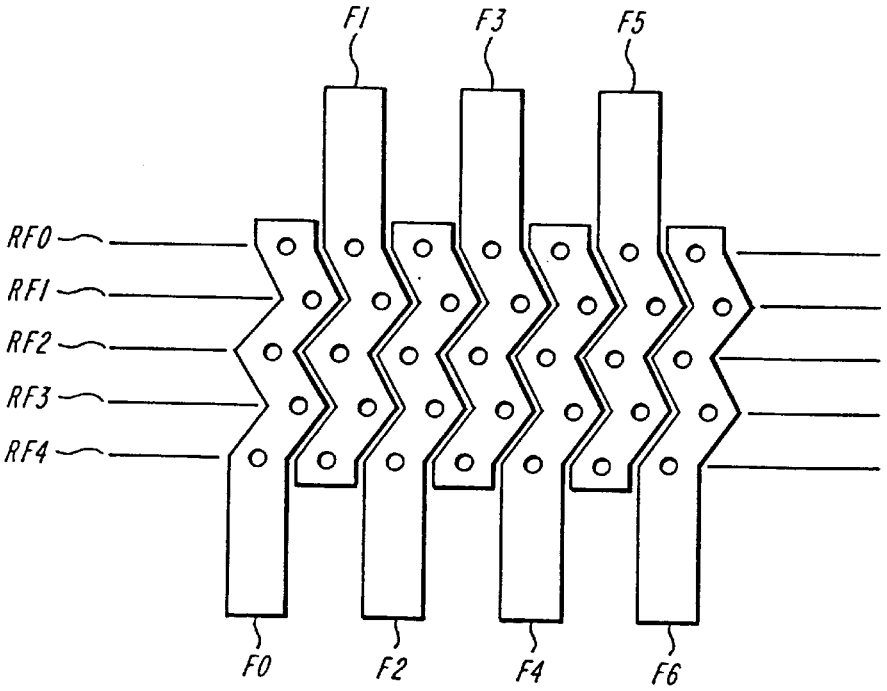

FIGS. 16 and 17 show a similarly-related pair of print head finger electrode configurations for interspersing strong and weak dots (i.e. central drive line and edge drive line charge packets) from a single finger. In this embodiment all finger segments are the same length—that is each zig or zag segment of a finger has two charge dot loci, with one at the corner being common to both segments, and each finger deposits five dots of alternating charge magnitude in a purely serial fashion, following the dots of the finger to its left and preceding those of its finger to the right.

Thus, the invention contemplates a method of depositing charge dots of uniform magnitude from a matrix array of crossing points of first and second electrodes, by arranging that the number or spacing of the electrodes to intersperse weak dots and strong dots as the electrodes are actuated. It will be understood that in the foregoing discussion the properties of "weak" and "strong" dots have been described in relation to the magnitude of delivered charge which is a function in part of the print head alignment and positioning over a curved drum or imaging surface, and that relative values in arbitrary units have been used by way of example. However, it will be understood by those skilled in the art that various constructions and techniques have evolved for controlling the charge or minimizing variations in dot magnitude, and these techniques include the provision of screen electrode opening or dot apertures in the print head of different size to compensate for charge drop off and related effects, provision of different structures or materials to affect charging, and the use of low curvature imaging members, so that the actual dot strength may be mitigated by such corrections. Thus, while charge variation in a given system may be smaller, applicant intends the terms "weak" and "strong" to be used in their normal sense and intends that the principles of the invention apply to all such systems and not be limited to the particular forms of charge variation described above. What is important is that the matrix of electrodes are arranged to deposit weak and strong dots in an interspersed fashion, and that this is achieved with a geometric layout of electrodes defining the charge loci such that the precise numbering and relative positions of the lattice points of dots of each type alternate at the surface of the imaging member. The invention being thus disclosed and described, further variations and modifications will occur to those skilled in the art and all such variations and modifications together with their equivalents are intended to be within the spirit and scope of the invention, as described herein and defined by the claims appended hereto.

What is claimed is:

1. A method of forming a charge image on a curved imaging member, said method comprising the steps of providing an odd number of first electrodes all extending parallel to each other in a cross-scan direction, providing a plurality of zig-zag shaped second electrodes extending substantially parallel to each other in a direction transverse to said first electrodes to define an array of crossing points at which actuation of one of said first electrodes and one of said second electrodes generates a charge image dot on the curved imaging member, wherein said first electrodes each have a different position offset along a print feed direction and define said crossing points that generate a charge that varies with said position to form strong and weak dots on the curved imaging member, wherein said weak dots are generated by said first electrodes with greater offset from a central position of the curved imaging member along said print feed direction, and actuating the first and second electrodes to deposit an image of said strong and weak charge image dots on the curved imaging member when the first electrodes are actuated in a sequence corresponding to said position of said first and second electrodes, such that said strong and weak dots alternate along an image line to form a substantially uniform charge distribution.

2. The method of claim 1, wherein the step of providing said second electrodes comprises the step of providing said second electrodes inclined and positioned so that each one of said second electrodes overlaps in said cross-scan direction at least a portion of an adjacent one of said second electrodes to form said uniform charge distribution.

3. The method of claim 1, wherein the step of providing said second electrodes extending transverse to said first electrodes comprises the step of providing said second electrodes having two different pitches disposed such that crossing points defined by the second electrodes interpose a weaker charge image dot between each two stronger charge image dots.

4. The method of claim 1, wherein the step of actuating the first and second electrodes comprises the step of actuating the first and second electrodes in a sequence corresponding to the positions of said first electrodes.

5. The method of claim 1, further comprising the step of interspersing said strong and weak charge dots to form a continuous sequence of charge image dots on the imaging member.

6. A print head for recording on a curved imaging member, comprising a plurality of n drive electrodes extending parallel to each other in a first layer along a print width direction, the drive electrodes each being successively offset along a print feed direction, and a plurality of zig-zag shaped m finger electrodes in electrical communication with one or more of the drive electrodes and disposed in a second layer parallel to and separated from said first layer by a layer of dielectric material and extending in a direction transverse to said print width direction to define a m×u lattice array of crossing points where said drive and finger electrodes overlap, wherein the crossing points generate charge carriers to form charge image dots opposed thereto when the drive electrodes and finger electrodes are actuated, wherein some of said drive electrodes define weak charge image dots and other of said drive electrodes define strong charge image dots, and wherein n is an odd integer and the m finger electrodes are disposed such that all the crossing points span a line in the print width direction, and such that when actuated said arrangement of said drive and finger electrodes intersperses strong charge dots with weak charge dots to deposit a charge image of substantially uniform charge density free of adjacent dot pairs having extreme charge values on the curved imaging member, whereby striping of said image is prevented.

7. A print head according to claim 6, further comprising means for actuating the zig-zag finger electrodes to deposit a continuous sequence of charge image dots without dots from adjacent finger electrodes.

8. A print head according to claim 6, wherein a portion of each zig-zag electrode is offset relative to another portion of said electrode.

9. A print head comprising a plurality of n drive electrodes extending parallel to each other in a first layer along a print width direction, the drive electrodes each being successively offset along a print feed direction, and a plurality of zig-zag shaped m finger electrodes in electrical communication with one or more of the drive electrodes and disposed in a second layer parallel to and separated from said first layer by a layer of dielectric material and extending in a direction transverse to said print width direction To define a m×n lattice array of crossing points where said drive and finger electrodes overlap, wherein the crossing points generate charge carriers to form charge image dots opposed thereto when the drive electrodes and finger electrodes are actuated, wherein n is an odd integer and the m finger electrodes are disposed such that all the crossing points span a line in the print width direction.

10. A method of forming a charge image on a curved imaging member, said method comprising the steps of providing a plurality of n drive electrodes extending parallel to each other along a print width direction, providing a plurality of zig-zag shaped m finger electrodes disposed in electrical communication with one or more of the drive electrodes and extending in a direction transverse to said print width direction to define an m×n lattice array of crossing points where said drive and finger electrodes overlap, wherein the crossing points generate charge carriers to form charge image dots on the imaging member when the drive electrodes and finger electrodes are actuated, configuring some of said drive electrodes to define weak charge image dots on the curved imaging member and configuring other of said drive electrodes to define strong charge image dots on the curved imaging member when actuated, and wherein n is an odd integer and the m finger electrodes are disposed such that all the crossing points span a line in the print width direction.

11. The method of claim 10, further comprising the step of actuating said drive and finger electrodes to intersperse said strong charge dots with said weak charge dots To deposit a charge image on the curved imaging member.

* * * * *